US006976580B2

(12) United States Patent
Okuyama et al.

(10) Patent No.: US 6,976,580 B2
(45) Date of Patent: Dec. 20, 2005

(54) GOLF BAG WITH A STABLE BASE

(75) Inventors: Masaaki Okuyama, Yao (JP); Satoshi Yoshida, Katano (JP); Toshiya Horioka, Osaka (JP); Hidenobu Kuba, Hirakata (JP)

(73) Assignee: Mizuno Corporation, Osaka (JP)

( * ) Notice: Subject to any disclaimer, the term of this patent is extended or adjusted under 35 U.S.C. 154(b) by 37 days.

(21) Appl. No.: 10/288,811

(22) Filed: Nov. 6, 2002

(65) Prior Publication Data

US 2003/0111371 A1 Jun. 19, 2003

(30) Foreign Application Priority Data

Nov. 6, 2001 (JP) ..... P2001-341296

(51) Int. Cl.[7] ..... A63B 55/00
(52) U.S. Cl. ..... 206/315.3; 206/315.7
(58) Field of Search ..... 206/315.3, 315.7, 206/315.8; 248/96; 211/70.2; 190/18 R

(56) References Cited

U.S. PATENT DOCUMENTS

| | | | | | |
|---|---|---|---|---|---|
| 1,438,263 | A | * | 12/1922 | Rothschild | 206/315.8 |
| 1,452,084 | A | | 4/1923 | Luckett | |
| 1,596,231 | A | | 8/1926 | Bennett | |
| 1,606,113 | A | * | 11/1926 | Walcott | 248/96 |
| 1,606,504 | A | | 11/1926 | Burky | |
| 1,657,170 | A | * | 1/1928 | McLaren | 248/96 |
| 1,715,101 | A | * | 5/1929 | Shanahan | 206/315.7 |
| 1,811,296 | A | * | 6/1931 | Boden et al. | 248/96 |
| 1,904,731 | A | * | 4/1933 | Harris | 206/315.7 |
| 2,275,297 | A | * | 3/1942 | Hearnshaw | 248/96 |
| 2,867,257 | A | | 1/1959 | Cart | |
| 4,181,167 | A | * | 1/1980 | Ret | 206/315.6 |
| 4,266,589 | A | * | 5/1981 | Cochran | 206/315.3 |
| 4,782,948 | A | * | 11/1988 | Weise | 206/315.7 |
| 4,865,192 | A | | 9/1989 | Williams | |

(Continued)

FOREIGN PATENT DOCUMENTS

| | | | | |
|---|---|---|---|---|
| EP | 1078656 A2 | * | 2/2001 | A63B/55/08 |
| GB | 2212404 A | * | 7/1989 | A63B/55/00 |
| JP | 55-098349 | | 7/1980 | |
| JP | 62-72672 | | 5/1987 | |
| JP | 04240461 A | * | 8/1992 | A63B/55/00 |
| JP | 4-124177 | | 11/1992 | |
| JP | 5-76470 | | 10/1993 | |

*Primary Examiner*—Sue A. Weaver
(74) *Attorney, Agent, or Firm*—John S. Pratt; Kilpatrick Stockton LLP

(57) ABSTRACT

A golf bag with a base having protrusion forming regions at a first section ranging from 30 to 60 degrees from a reference line, a second section ranging from 120 to 150 degrees from the reference line, a third section ranging from 210 to 240 degrees from the reference line, and a fourth section ranging from 300 to 330 degrees from the reference line. At each of the protrusion forming regions, one or more protrusions are formed to prevent the golf bag from rotating and falling over. A pair of tangents drawn from two of the protrusions in the front-rear direction and a pair of tangents drawn from two of the protrusions in the lateral direction pass outside of a base peripheral edge. Auxiliary protrusions may also be formed on the base at the positions of 90 degrees and 270 degrees from the reference line. All tangents linking the adjacent protrusions and all tangents linking the adjacent protrusion and auxiliary protrusion may pass outside of the base peripheral edge.

9 Claims, 11 Drawing Sheets

U.S. PATENT DOCUMENTS 4,942,962 A 7/1990 Jordan
5,303,888 A 4/1994 Seop
5,340,063 A 8/1994 Hsieh
5,356,003 A 10/1994 Gretz et al.
5,445,267 A 8/1995 Biafore, Jr.
5,450,955 A 9/1995 Olson
5,456,355 A 10/1995 Usswald et al.
5,713,543 A * 2/1998 Ruth et al. ..... 248/96
5,941,383 A 8/1999 Cheng
6,062,383 A 5/2000 Han
6,148,998 A 11/2000 Tan
6,220,433 B1 4/2001 Kang
6,298,988 B1 10/2001 Wen-Chien
6,318,682 B1 11/2001 Chen
6,390,295 B2 * 5/2002 Rhee ..... 206/315.7
6,435,345 B1 8/2002 Wang
6,648,137 B2 * 11/2003 Hamamori ..... 206/315.3
2002/0033583 A1 * 3/2002 Engelhardt et al.

* cited by examiner

PRIOR ART

GOLF BAG WITH A STABLE BASE

TECHNICAL FIELD

The present invention relates to a golf bag having a particularly stable base, and more particularly to a golf bag having a base with protrusions that correspond to mechanisms by which a golf bag falls over.

BACKGROUND OF THE INVENTION

As shown in FIG. 1, a golf bag 31 is formed as a tall structure for accommodating golf clubs, and the weight of the accommodated golf clubs is concentrated at the upper portion of the golf bag. When a golf bag with such a structure is set upright on the ground, it is apt to fall over.

To increase stability, it is considered effective to increase the size of the base. The base diameter for a large size golf bag is as wide as 10 inches.

A general golf bag is equipped with a grip 32 for carrying the golf bag. Since golf clubs accommodated in the golf bag are composed of a shaft and a head having the center of gravity at a position offset from the shaft axial line, the heads are aligned in a specific direction, projecting in a direction opposite from the grip after carrying it, and the position of these clubs can exert a force that causes the golf bag to fall down.

Furthermore, golf bags typically are furnished with a front pocket 34 at the grip side and a back pouch 33 at the opposite side. When these pockets are filled, especially when the back pouch is filled with articles, the golf bag becomes even more likely to fall in the opposite direction from the grip.

Japanese Laid-open Utility Model No. 62-72672 discloses protrusions 38 formed near the base 37 on the grip side of the golf bag as shown in FIGS. 3–5, but this approach has been found not to be fully satisfactory.

There also exist bases formed in an elliptical shape having the major elliptical axis aligned with the grip and the opposite side (hereinafter called a front-rear direction as shown in FIG. 2), or a base in a square shape with smooth curved sides and round corners. Japanese Laid-open Utility Model No. 5-76470 also proposes a rectangular base.

When a base is larger, however, the mass of the base also increases. Although the center of gravity of the golf bag goes down with the increase of the base mass and the stability is improved, the golf bag itself becomes heavier, thus making it hard to handle. It also becomes hard to handle when a base is formed in a polygonal shape. When the inside diameter of a golf bag base is increased, golf clubs in the bag rest against a top frame 35 of the golf bag on one side with the grip ends of the clubs touching against the inner bottom of the other side of the golf bag. This increases the inclination of the golf clubs and also increases the force tending to cause the golf bag to fall over.

In summary, golf bags fall over after going through the following steps.

a. When the golf bag is set up on the ground, golf clubs accommodated in the golf bag incline toward the rear of the bag, opposite the grip.

b. Due to the inclination of the golf clubs, the golf bag also inclines in the same front-rear direction as the inclination of the golf clubs.

c. As a result of the inclination of the golf bag, the golf bag rotates along the base peripheral edge, shifting its direction of inclination from the front-rear direction to the lateral direction.

d. Due to the inclination of the golf bag in the lateral direction, the golf club heads move toward in the lateral direction, toward the side of the bag resulting in the inclination of the golf clubs in the lateral direction.

e. Due to the lateral inclination of the golf clubs, the lateral inclination of the golf bag increases further.

Because partitions at the top of the bag run side to side, as shown in FIG. 2, which illustrates such partitions 36, the golf bag becomes unstable dynamically like a shift of cargo when rotation of the golf bags begins at step c because the clubs readily shift to one side.

Because of this, although the arrangement of protrusions as shown in FIG. 3 or FIG. 4 proposed in Japanese Laid-open Utility Model No. 62-72672 is less likely to make the golf bag fall in the front direction, the forward inclination is followed by rotation, which instead promotes inclination of the clubs in the lateral direction and makes the golf bag more likely to fall over. The same thing happens with an elliptical base having the major axis in the front-rear direction or a square base with curved sides and round corners. When the protrusions are disposed as shown in FIG. 5, the bag becomes unlikely to fall in the front direction, but since there is no structure to improve the stability in the lateral direction toward which the bag is likely to fall, and since there is no rotation-preventing structure, falling is not adequately prevented.

The rectangular base disclosed in Japanese Laid-open Utility Model No. 5-76470 is designed such that the inclination in the front-rear direction is not transferred to the lateral direction. While it can be expected to have a preventive effect of rotation of a golf bag, the structure is narrow in the lateral direction in order to save space, and therefore, stability in the lateral direction is not necessarily improved.

SUMMARY OF THE INVENTION

The golf bag of the present invention solves the above mentioned problems of the prior art, and provides a golf bag that is less likely to fall over without increasing its mass or dimensions, by providing protrusions at the base portion, which prevent rotation of the golf bag and improve its dynamic stability. As used herein, "protrusion" means the entire portion protruded from the plate-like base in the downward and radial directions.

In accordance with the invention, these objects are accomplished by providing a golf bag having a base with protrusion forming regions at a first section ranging from 30 to 60 degrees from a reference line, a second section ranging from 120 to 150 degrees from the reference line, a third section ranging from 210 to 240 degrees from the reference line, and a fourth section ranging from 300 to 330 degrees from the reference line, and having one or more protrusions formed at each of the protrusion forming regions.

As used herein, "a reference line" means a line passing through the center of the base and a point on the base peripheral edge that is closest to a grip of the golf bag.

In a preferred embodiment of the invention, at least a pair of tangents drawn from one of the protrusions in the front-rear direction and at least a pair of tangents drawn from one of the protrusions in the lateral direction pass outside of the base peripheral edge.

As used herein, "a pair of tangents" means, for example, two front-rear tangents 11 at the right side and left side of the base as shown in FIG. 7. However, it is not necessary that positions of the tangents be symmetrical.

In a preferred embodiment, the protruding length of the protrusion from the base peripheral edge may be from 10 mm to 50 mm.

The present invention also provides a golf bag having a base with protrusion forming regions at a first section ranging from 30 to 60 degrees from the reference line, a second section ranging from 120 to 150 degrees from the reference line, a third section ranging from 210 to 240 degrees from the reference line, and a fourth section ranging from 300 to 330 degrees from the reference line, and having one or more protrusions formed at each of the protrusion forming region, in which a tangent drawn from one of the protrusions in the lateral direction passes outside of a base peripheral edge, and an auxiliary protrusion is formed at the positions of 90 degrees and 270 degrees from the reference line.

In a preferred embodiment, the protruding length of the protrusion from the base peripheral edge may be from 10 mm to 50 mm.

In a preferred embodiment of the invention, the protruding length of the auxiliary protrusion from the base peripheral edge is from 8 mm to 20 mm, and the auxiliary protrusion is shorter than the principal protrusions.

In a more preferred embodiment of the invention, all tangents linking the adjacent protrusions pass outside of a base peripheral edge. Also, all tangents linking the adjacent protrusions and all tangents linking the adjacent protrusion and auxiliary protrusion pass outside of the base peripheral edge.

DETAILED DESCRIPTION OF DISCLOSED EMBODIMENTS

Figure 1:
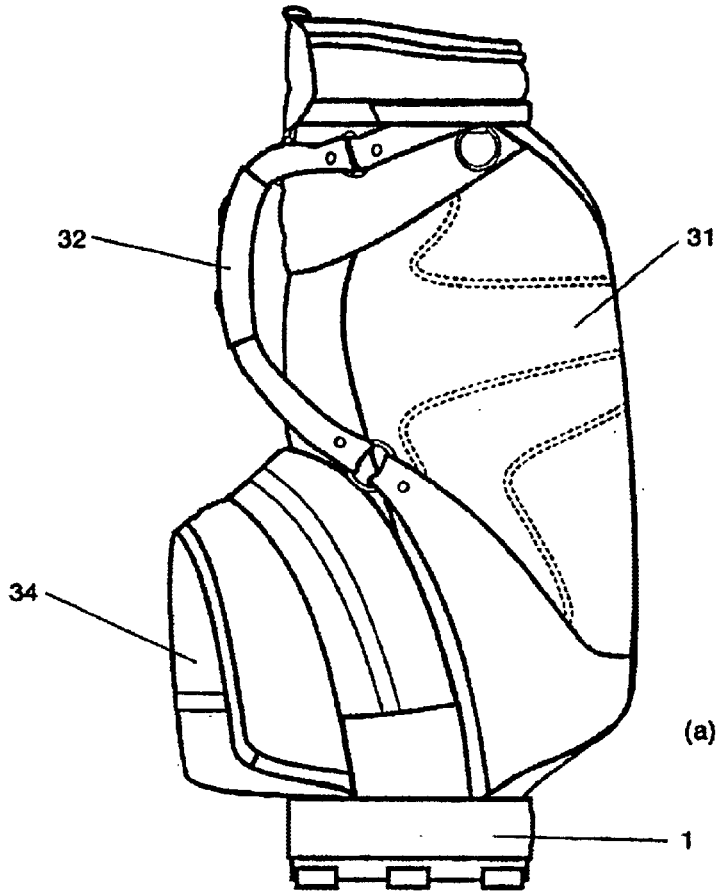
FIG. 1 PRIOR ART
FIG. 1 is a side view of a conventional golf bag shown without a hood.

Preferred embodiments of the invention are described below.

The golf bag of the present invention is provided with a base having protrusion forming regions 5 at a first section 21 ranging from 30 to 60 degrees from a reference line R, a second section 22 ranging from 120 to 150 degrees from the reference line, a third section 23 ranging from 210 to 240 degrees from the reference line, and a fourth section 24 ranging from 300 to 330 degrees from the reference line, and one or more protrusions 2 are formed at each of the protrusion forming region. The reference line R is a line passing through the center 4 of the base and a point 10 on a base peripheral edge 6 that is closest to a grip of the golf bag. The angles are measured counterclockwise from the point 10, which is designated as 0 degree. A protrusion forming position is the point on the base peripheral edge 6 intersected by a line linking the graphic center 8 of the protrusion and the center 4 of the base.

Figure 2:
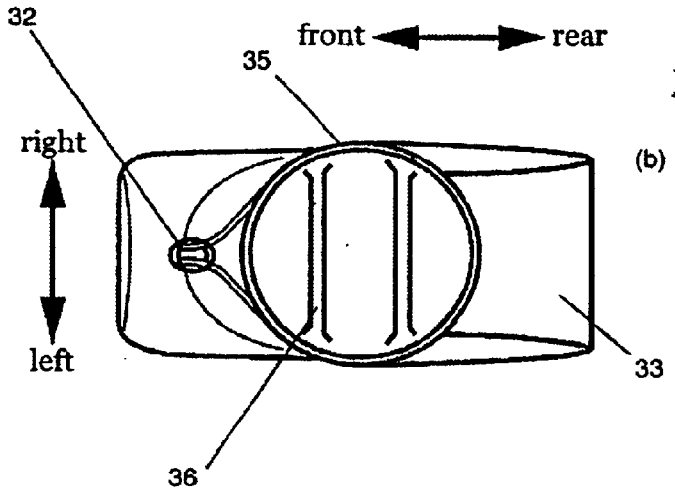
FIG. 2 PRIOR ART
FIG. 2 is a top view of the conventional bag shown in FIG. 1.
Figure 3:
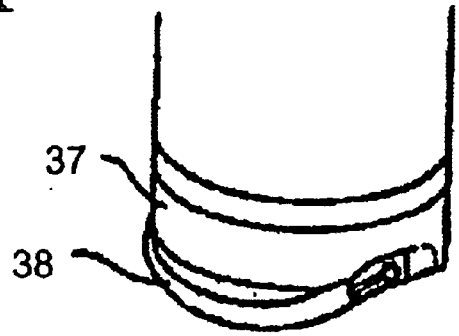
FIG. 3 PRIOR ART
FIG. 3 is a fragmentary perspective view of a conventional golf bag base having a protrusion.
Figure 4:
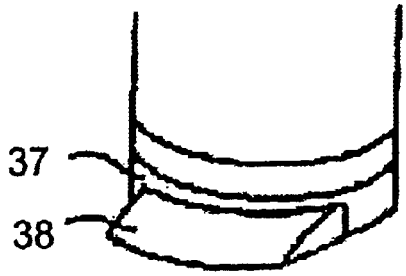
FIG. 4 PRIOR ART
FIG. 4 is a fragmentary perspective view of another conventional golf bag base having a protrusion.
Figure 5:
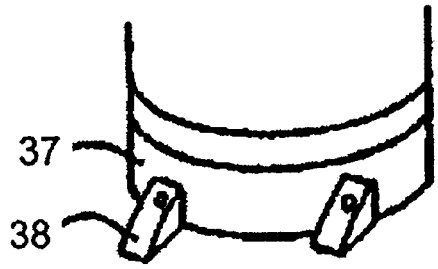
FIG. 5 is a fragmentary perspective view of yet another conventional golf bag base having two protrusions.

Inclination of a golf bag often starts in the front-rear direction as shown in FIG. 2 depending on the grip position and the configuration of a front pocket and a back pouch. However, the golf bag usually falls over after it rotates along the base peripheral edge 6 and its inclination is transferred to the inclination in the lateral direction which is dynamically unstable. Therefore, preventing the rotation of the golf bag can also prevent it from falling down.

Furthermore, a pair or plural pairs of tangents 11 drawn from the protrusions 2 in the front-rear direction and a pair or plural pairs of tangents 12 drawn from the protrusions 2 in the lateral direction are arranged such that they pass outside of the base peripheral edge 6.

As long as slipping does not occur between the base 1 and the ground, stability against inclination depends on a minimum diameter of the base 1. Since the height of the center of gravity and the inclination of golf clubs contained in the bag do not change, stability of a golf bag increases when the minimum diameter of the base 1 increases. Therefore, the stability can be increased by making the distance from the base center 4 to the outermost portion of the protrusions 2 longer than the distance from the base center 4 to the base peripheral edge 6 in the front-rear direction in which leaning is initiated and in the lateral direction which is unstable dynamically.

It is preferable that the protrusions 2 protrude a distance L 10 mm to 50 mm from the base peripheral edge 6.

Figure 6:
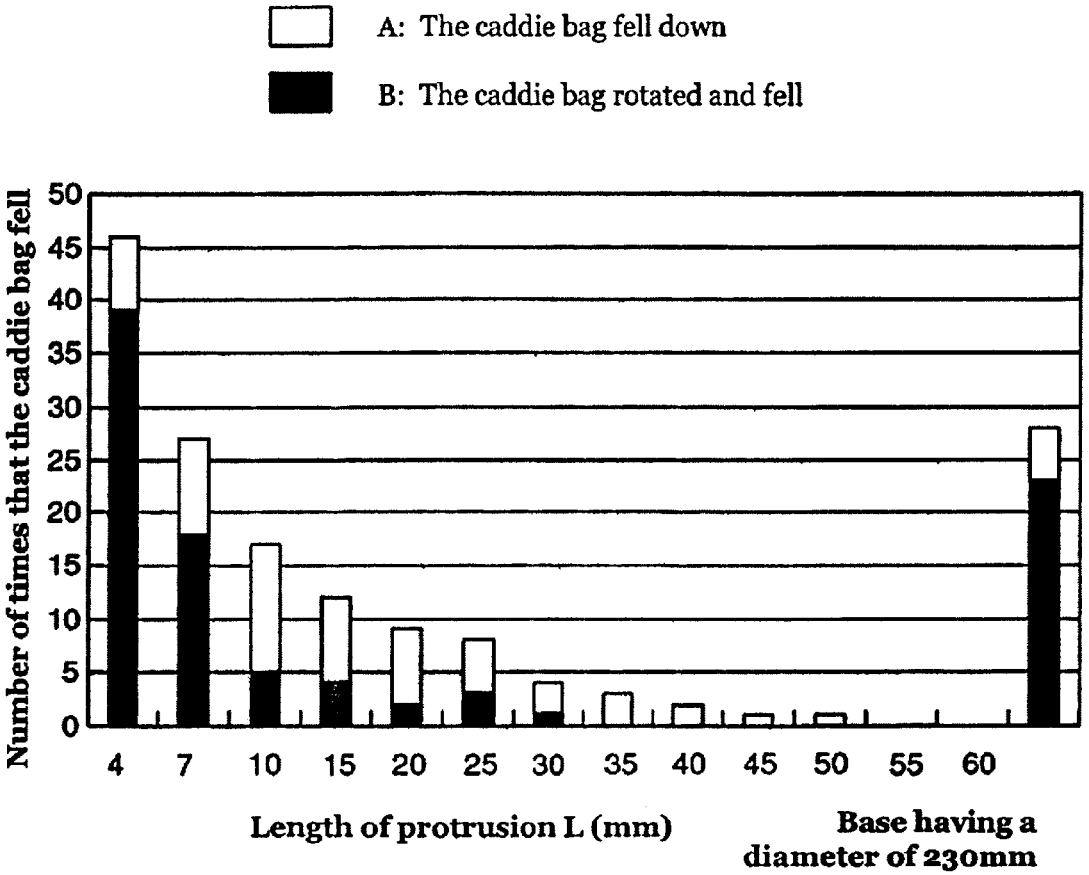
FIG. 6 is a graphic chart of test results showing the relation between the length of the protrusions and the number of times that a golf bag fell.

FIG. 6 shows results of golf bag falling or tumbling tests, using a golf bag accommodating a full set of golf clubs and ten golf balls in a front pocket. The first wood and the third wood to the fifth wood, a total of four woods were arbitrarily put in a grip side compartment, the fourth iron to the eighth iron were put in a central compartment, and the ninth iron, three wedges and the putter were put in a compartment on an opposite side from the grip. The golf bag was shaken by holding the grip, and was set up on the ground, and then was inclined by 8 degrees away from the grip, and the number of times that the golf bag fell down was counted. This test for each golf bag was repeated 50 times.

In the experiment, a base having a diameter of 215 mm was used, and circular protrusions of different diameters separate body from the base were formed at the positions of 45 degrees, 135 degrees, 225 degrees, and 315 degrees from the reference line R.

In the test results, A denotes the number of times that a golf bag fell in the front-rear direction, and B denotes the number of times that a golf bag rotated along the base and fell down in the lateral direction.

From the test results, it can be seen that unless the protruding length L of the protrusion from the base peripheral edge is at least 10 mm, the rotary motion of the golf bag causes the golf bag to fall in the lateral direction. Thus, a longer protruding length L improves stability. However, if protruding length L is too long, the golf bag becomes hard to handle or carry. From the test results, the benefit of the protrusions do not increase when the length L exceeds 50 mm, and hence it can be seen that the maximum length of 50 mm is sufficient.

Although the rotation preventive effect varies depending on the shape of a protrusion, the circular protrusion used in this experiment is the least effective. The circular protrusion, however, is a preferable embodiment for practical reasons, since it does not easily get caught accidentally and is easy to handle. Therefore, it can be said that if protruding length L is within this length range, there is sufficient rotation prevention regardless of the shape of protrusion.

A similar experiment was conducted by using a base of 230 mm in diameter with no protrusions. When comparing a base of 215 mm in diameter having protrusions of 10 mm in length formed on the base and the base of 230 mm in diameter with no protrusions, the distance from the base center 4 is approximately the same, about 115 mm in both cases, but the base of 215 mm in diameter having protrusions was found to be less likely to fall than the base of 230 mm in diameter with no protrusions.

Figure 7:
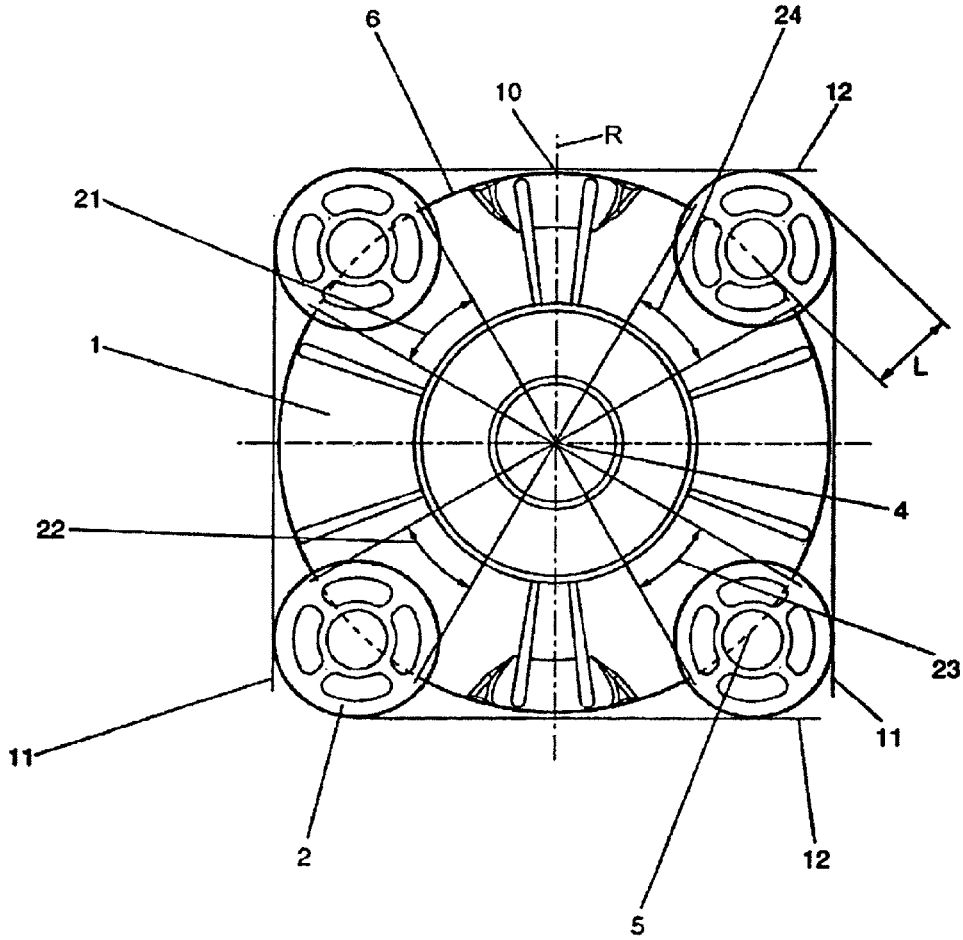
FIG. 7 is a bottom view of a golf bag base according to one embodiment of the present invention.

In another embodiment, protrusions 2 at the protrusion forming regions 5 contribute to the improvement in the stability against inclination of the golf bag in the front-rear direction and contribute to the prevention of rotation, while auxiliary protrusions 3 are responsible for the improvement of the stability in the lateral direction. In order to make each pair of tangents 11 drawn from the protrusion in the front-rear direction and each pair of tangents 12 drawn from the protrusion in the lateral direction pass outside of the base peripheral edge 6 when just one protrusion is formed at each of the protrusion forming region as shown in the embodiment of FIG. 7, the protruding length L of 45mm is necessary for a base of 215 mm in diameter. As the mass of the protrusion is increased, the base becomes heavier. However, by dividing the stabilizing elements into protrusions 2 and auxiliary protrusions 3, it becomes possible to decrease the dimension of each protrusion, reducing the increase of the mass, and safety in carrying the golf bag can also be enhanced.

In this case, too, it is preferred that the protruding length of the protrusion 2 is from 10 mm or more to 50 mm or less from the base peripheral edge 6. Furthermore, although the position of the auxiliary protrusion 3 is most preferably at 90 degrees and 270 degrees from the reference line, the same effect can be obtained as long as the auxiliary protrusions are the ones that protrude most in the lateral direction.

When an external force acts on a golf bag, inclination may be initiated in a direction other than the front-rear direction or the lateral direction. In such a case, if a tangent 13 linking the adjacent protrusion 2 and auxiliary protrusion 3 intersects with the base peripheral edge 6 with one intersection, or with two intersections, it is thought that the area of the intersection or the area between such two intersections becomes the area that is dynamically unstable, and the golf bag falls after rotating up to the intersection. Accordingly, by making the tangent 13 linking the adjacent protrusion and auxiliary protrusion pass outside of the base peripheral edge 6, stability can be improved further.

To realize such a configuration, the protruding length l of the auxiliary protrusion should be enough if it is at least 8 mm, although it also depends on the length of the protrusion 2.

When playing golf, generally four golf bags are mounted on a golf cart. Taking into consideration the space for bags on a golf cart, in order to mount four golf bags, the protruding length l of the auxiliary protrusions should be kept within 20 mm.

Furthermore, similar stability can be achieved by making all the tangents 14 linking the adjacent protrusions pass outside of the base peripheral edge 6, or by making all the tangents 14 linking the adjacent protrusions and all the tangents 13 linking the adjacent protrusion and auxiliary protrusion pass through outside of the base peripheral edge 6.

In practicing the invention, the protrusions 2 and auxiliary protrusions 3 may be formed integrally with the base, or separately formed protruding parts may be attached to the base 1. If the protrusions 2 and auxiliary protrusions 3 are formed as hollow parts, less weight is added and the bag weight can be reduced.

Referring now in more detail to the drawings, FIG. 7 shows an embodiment in which circular protrusions 2 are formed at the positions of 45 degrees, 135 degrees, 225 degrees, and 315 degrees from the reference line R that connects the center 4 of the base and the point 10 on the base peripheral edge, which are the median values in the protrusion forming regions 5 of the first section to the fourth section.

Figure 8:
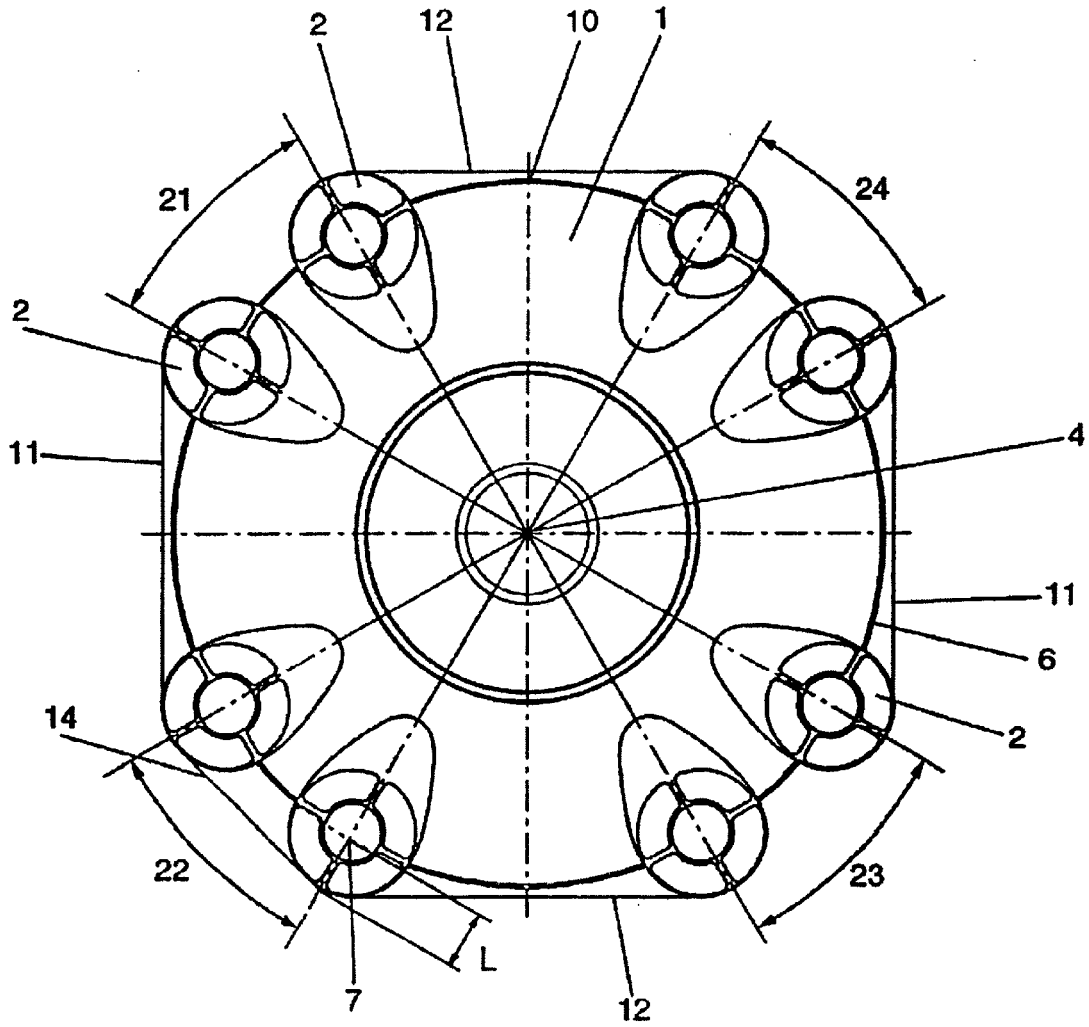
FIG. 8 is a bottom view of a golf bag base according to another embodiment of the present invention.

FIG. 8 shows an embodiment in which protrusions 2 are formed at positions of 30 degrees, 60 degrees, 120 degrees, 150 degrees, 210 degrees, 240 degrees, 300 degrees and 330 degrees from the reference line, and tangents 14 linking the adjacent protrusions are formed to pass outside of the base periphery edge 6.

Figure 9:
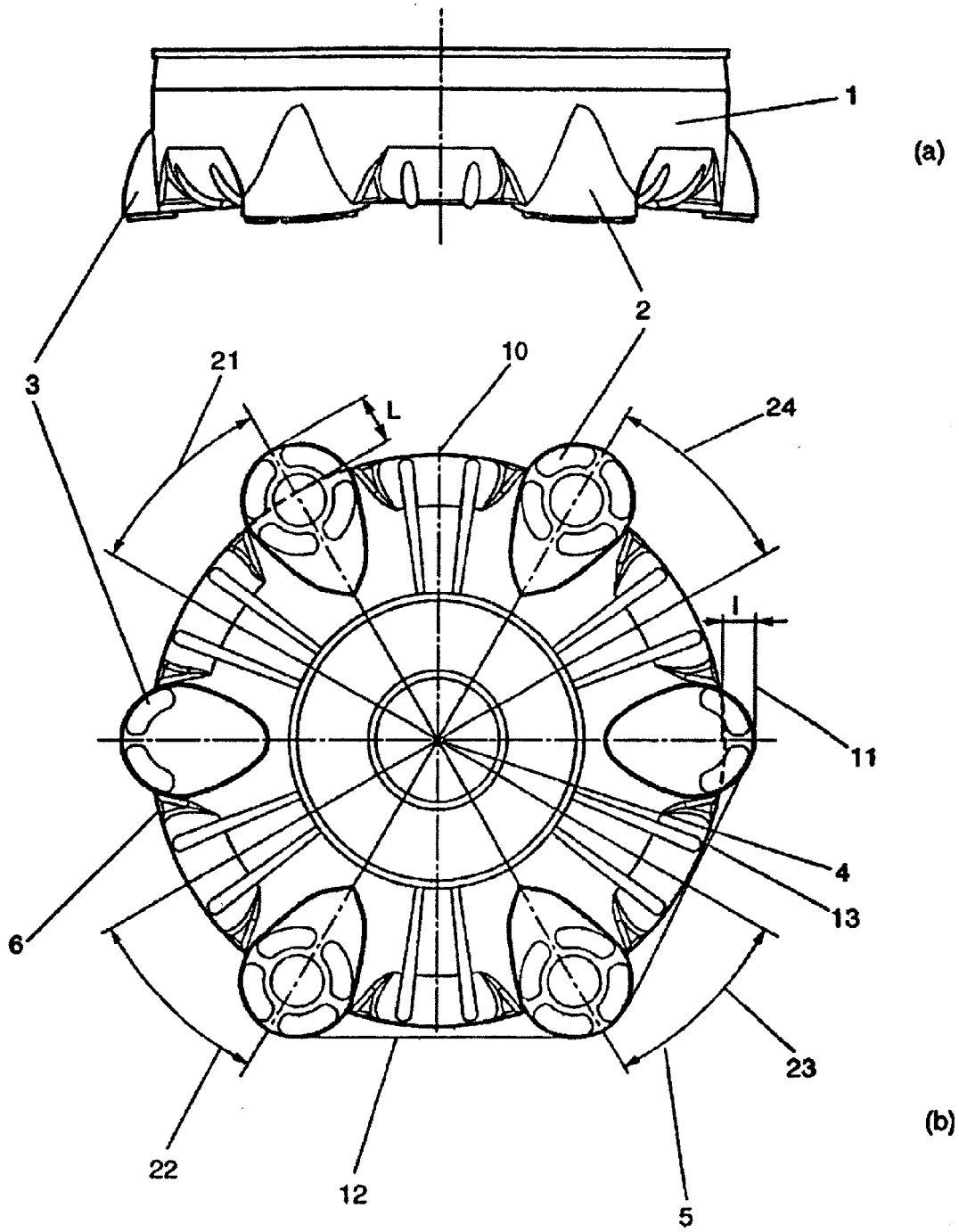
FIG. 9 is a bottom view of a golf bag base according to yet another embodiment of the present invention.

FIG. 9 shows an embodiment in which protrusions 2 for preventing rotation are formed at the positions of 30 degrees, 150 degrees, 210 degrees, and 330 degrees counterclockwise from the reference line, and auxiliary protrusions 3 for enhancing the stability in the lateral direction are formed at the positions of 90 degrees and 270 degrees from the reference line.

Since the tangent 13 of the adjacent protrusion 2 and auxiliary protrusion 3 passes outside of the base peripheral edge 6 in the embodiment of FIG. 9, regardless of the direction of inclination of the golf bag, rotary motion can be prevented and the stability is further enhanced. The stability can be further improved if protrusions 2 or 3 are sloped so that their portions most remote from the bag may contact with the ground more firmly than other portions.

Figure 10:
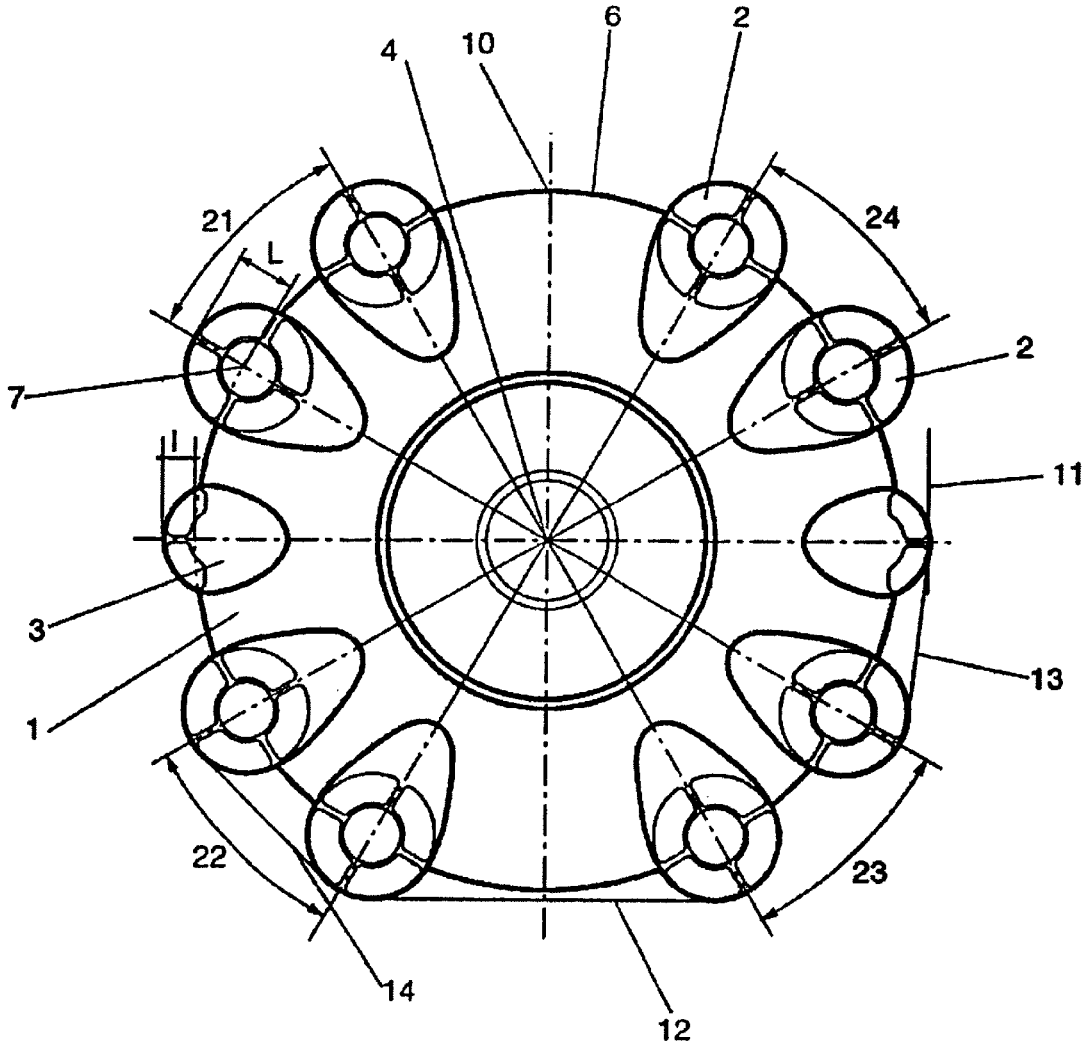
FIG. 10 is a bottom view of a golf bag base according to yet another embodiment of the present invention.

FIG. 10 shows a second embodiment in which protrusions 2 for preventing rotation are formed at the positions of 30 degrees, 60 degrees, 120 degrees, 150 degrees, 210 degrees, 240 degrees, 300 degrees and 330 degrees counterclockwise from the reference line, and auxiliary protrusions 3 for enhancing the stability in the lateral direction are formed at the positions of 90 degrees and 270 degrees from the reference line.

Figure 11:
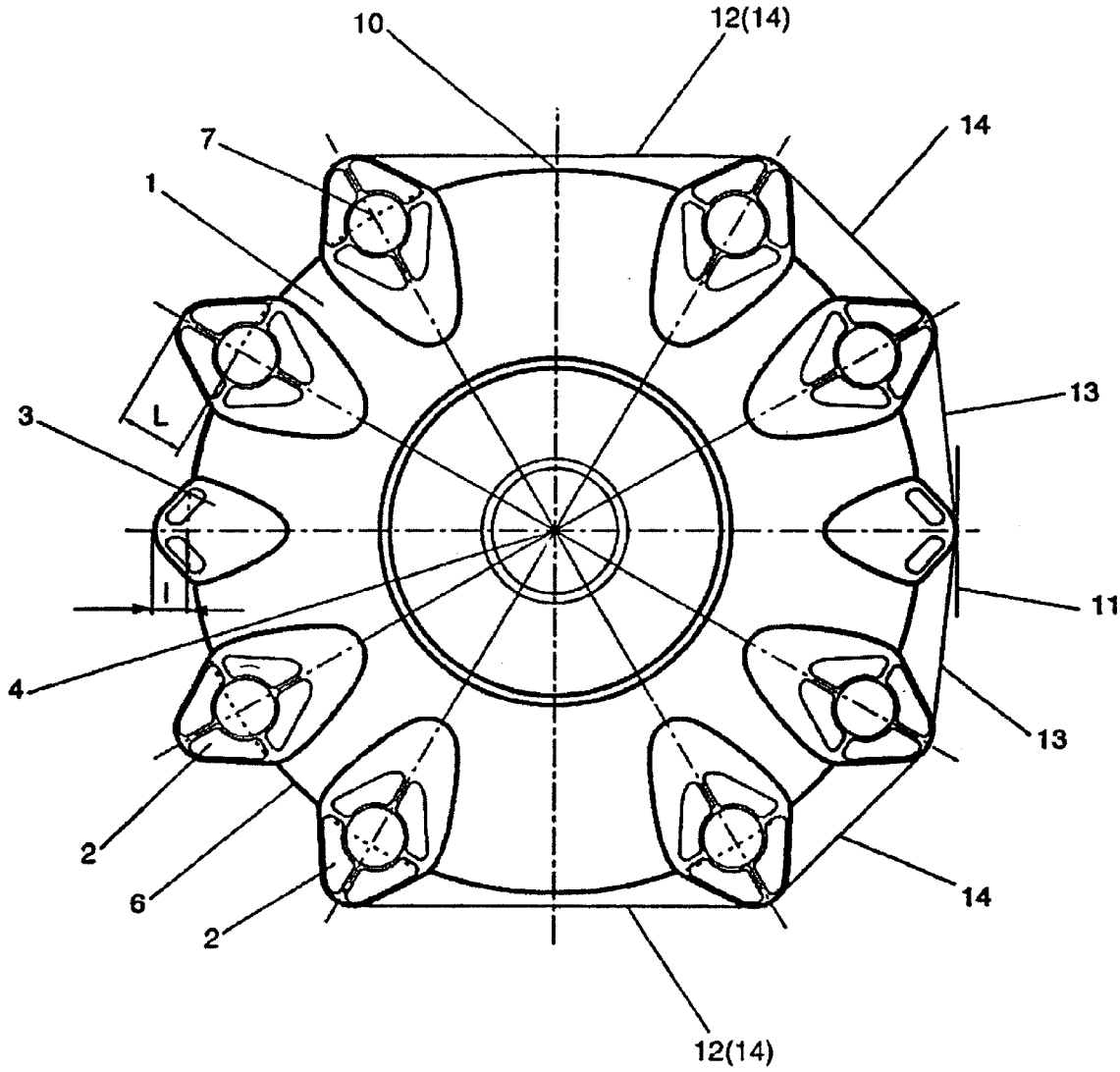
FIG. 11 is a bottom view of a golf bag base according to yet another embodiment of the present invention.

FIG. 11 shows an embodiment in which all the tangents 14 linking the adjacent protrusions and all the tangents 13 linking an adjacent protrusion and an auxiliary protrusion pass outside of the base peripheral edge 6. By providing such protrusions 2 and 3, rotation can be stopped regardless of which direction the golf bag is inclined, and stability can be enhanced without increasing the weight compared to the base having a polygonal shape.

In the above mentioned embodiments, the shape and configuration of the protrusions 2 and auxiliary protrusions 3 are symmetrical. Even if the positions of the protrusions 2 and auxiliary protrusions 3 are irregular, however, similar stability can be achieved by arrangement such that a pair of tangents 11 in the front-rear direction, a pair of tangents 12 in the lateral direction, and tangents 13 of the adjacent protrusion and auxiliary protrusion pass outside of the base peripheral edge 6.

Figure 12:
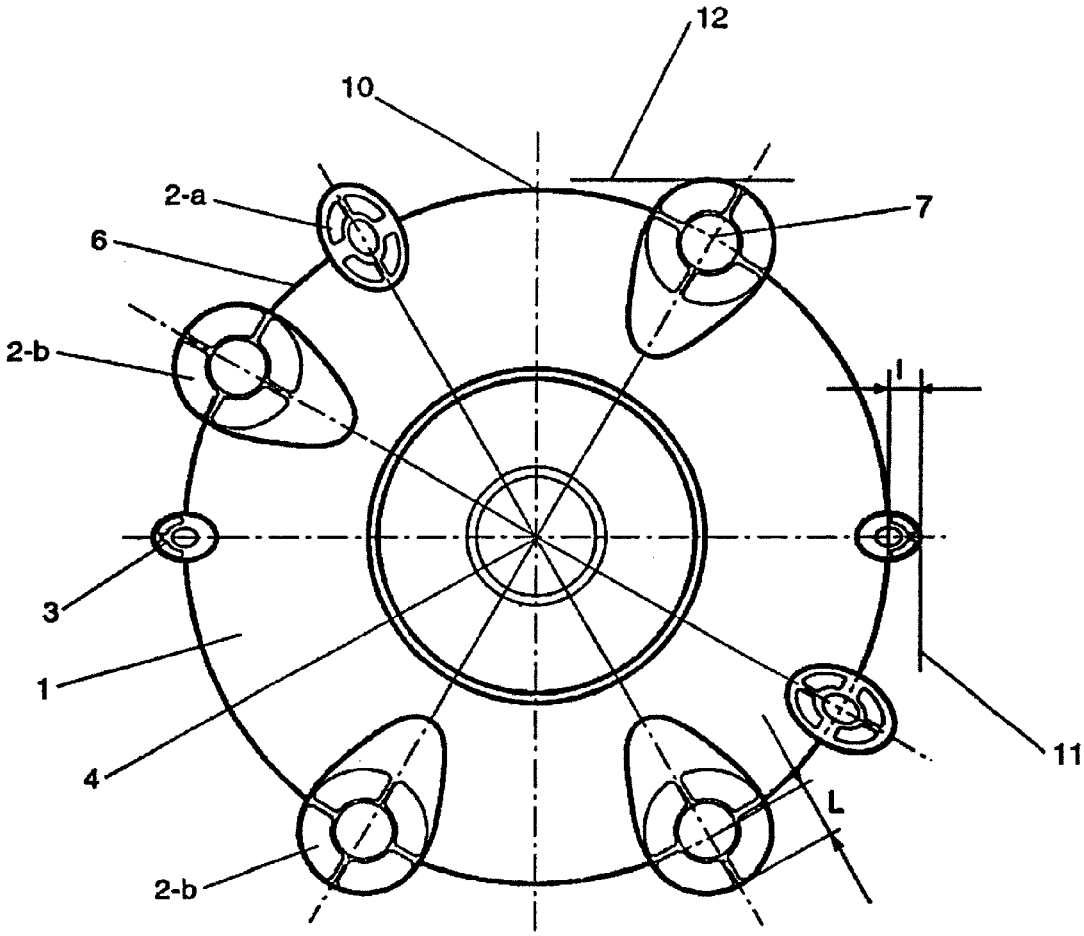
FIG. 12 is a bottom view of a golf bag base according to yet another embodiment of the present invention.

For example, FIG. 12 shows an embodiment having an asymmetric configuration in which at the first section, a small protrusion 2-*a* is formed at the position of 30 degrees, and a large protrusion 2-*b* is formed at the position of 60 degrees; at the second section, a large protrusion 2-*b* is formed at the position of 150 degrees; at the third section, a large protrusion 2-*b* is formed at the position of 210 degrees, and a small protrusion is formed at the position of 240 degrees, and at the fourth section, a large protrusion 2-*b* is formed at the position of 330 degrees, and auxiliary protrusions 3 are formed at the positions of 90 degrees and 270 degrees. As long as the tangents 12 drawn from one of the protrusions 2 in the lateral direction and the tangents 11 drawn from the auxiliary protrusions 3 in the front-rear direction pass outside of the base peripheral edge 6, the stability can be assured.

While the shape of the protrusions 2 and auxiliary protrusions 3 is circular in the embodiments, in order to enhance the rotation preventive effect, they may be formed in any arbitrary shape, including rectangular or elliptical shape, isosceles triangle or scalene triangle, isosceles trapezoid or scalene trapezoid, and other arbitrary polygonal shapes.

Figure 13:
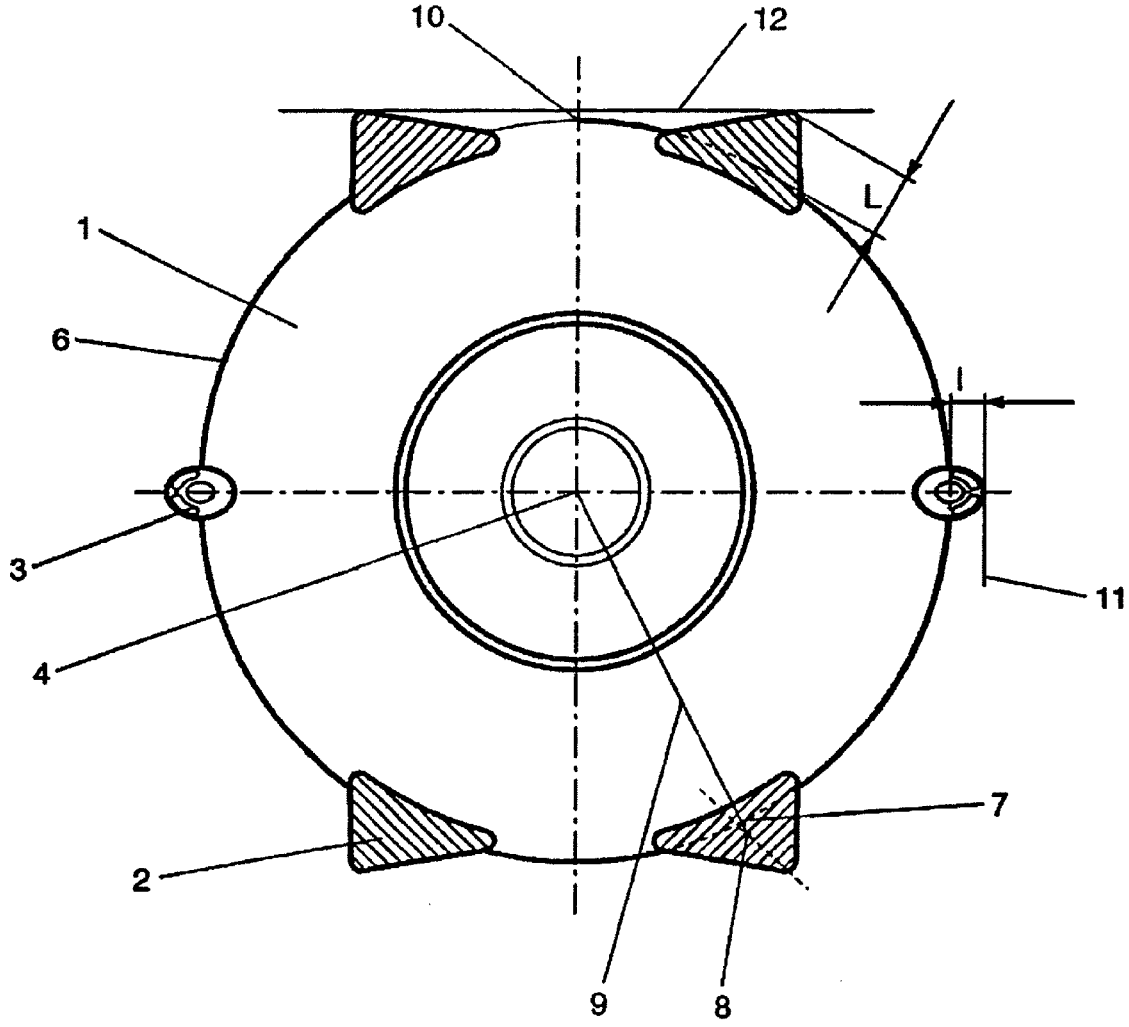
FIG. 13 is a bottom view of a golf bag base according to yet another embodiment of the present invention.

FIG. 13 shows an embodiment in which the shape of the protrusions 2 is a scalene triangle shape. The protrusions 2 in this embodiment are the four individual parts to which hatching is applied along a concentric circle, and a protrusion forming position 7 is an intersection of the base peripheral line 6 and a line 9 connecting the graphical center 8 of the protrusion 2 and the center 4 of the base. The protrusions 2 and auxiliary protrusions 3 are formed such that the tangents 12 drawn from the protrusions 2 in the lateral direction and the tangents 13 drawn from the auxiliary protrusions 3 in the front-rear direction pass outside of the base peripheral edge 6.

Figure 14:
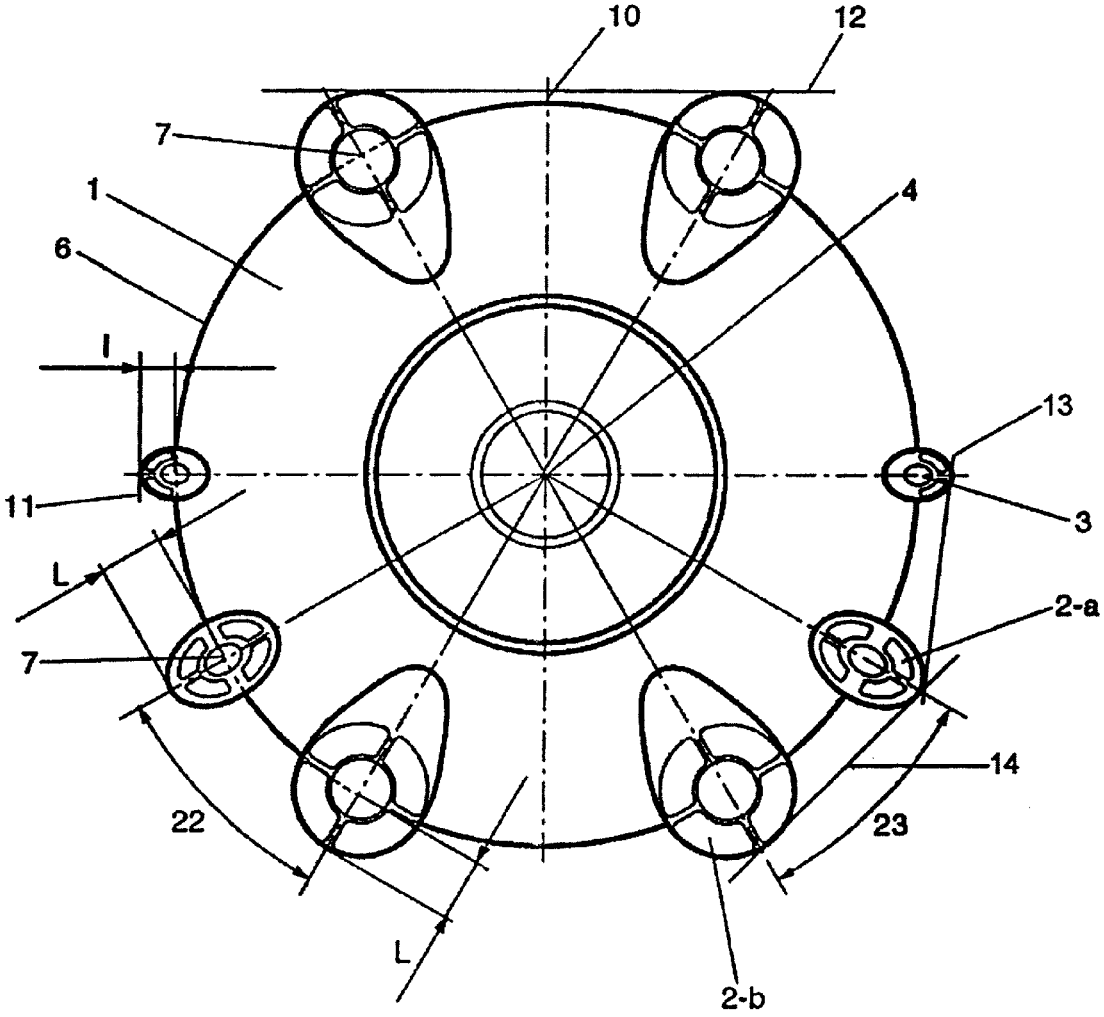
FIG. 14 is a bottom view of a golf bag base according to yet another embodiment of the present invention.

FIG. 14 shows an embodiment in which two protrusions 2 are formed at each of the second and the third sections that are most remote from the grip and are at the side toward which a golf bag is most likely to fall, and one protrusion 2 is formed at each of the first and the fourth sections that are closer to the grip, and auxiliary protrusions 3 are formed at the positions of 90 degrees and 270 degrees. In this embodiment, the protrusions 2 and auxiliary protrusions 3 are formed such that all the tangents 14 linking the adjacent protrusions 2 and all the tangents 13 linking the adjacent protrusion 2 and auxiliary protrusion 3 pass outside of the base periphery edge 6.

As described above, the golf bag of this invention can prevent rotation in such a way that the inclination in the front-rear direction which is apt to occur may not be transferred to a dynamically unstable inclination in the lateral direction, and therefore, the stability of the golf bag is enhanced.

Furthermore, since a tangent drawn between one of the protrusions in the front-rear direction and lateral direction is designed to pass outside of the base peripheral edge, the ability of the golf bag to resist falling caused by an external force can be improved.

Since the stability of the golf bag is improved more than when the diameter of the circular base is merely increased, a golf bag can be produced in a compact design without increasing mass or dimensions. Moreover, the amount of synthetic resin used as a main material of the base can be reduced, minimizing the environmental effects.

Since the bag base of this invention has a rotation preventive function, a bag with this base can be handled and carried stably when mounted on a golf cart or the like.

What is claimed is:

1. A golf bag, comprising:

a base (1) having protrusion forming regions (5) at a first section (21) ranging from 30 to 60 degrees from a reference line, a second section (22) ranging from 120 to 150 degrees from the reference line, a third section (23) ranging from 210 to 240 degrees from the reference line, and a fourth section (24) ranging from 300 to 330 degrees from the reference line;

at least one protrusion (2) formed within each of the protrusion forming regions; and an auxiliary protrusion (3) formed on the base at each of the positions of 90 degrees and 270 degrees from the reference line, wherein a tangent (12) drawn from one of the protrusions in the lateral direction passes outside of a base peripheral edge (6), and wherein the protruding length (1) of the auxiliary protrusion (3) from the base peripheral edge is shorter thin the protruding length (L) of the protrusion (2).

2. The golf bag according to claim 1, wherein the protruding length (L) of the protrusion (2) from the base peripheral edge (6) is from 10 mm to 50 mm.

3. The golf bag according to claim 2, wherein all tangents (14) linking adjacent protrusions (2) and all tangents (13) linking the adjacent protrusion (2) and auxiliary protrusion (3) pass outside of the base peripheral edge (6).

4. The golf bag according to claim 1, wherein all tangents (14) linking adjacent protrusions (2) and all tangents (13) linking the adjacent protrusion (2) and auxiliary protrusion (3) pass outside of the base peripheral edge (6).

5. The golf bag according to claim 1, wherein the reference line is a line passing through the center of the base and a point on the base peripheral edge that is closest to a grip of the golf bag.

6. A golf bag, comprising:

a base (1) having protrusion forming regions (5) at a first section (21) ranging from 30 to 60 degrees from a reference line a second section (22) ranging from 120 to 150 degrees from the reference line, a third section (23) ranging from 210 to 240 degrees from the reference line, and a fourth section (24) ranging from 300 to 330 degrees from the reference line; and at least one protrusion (2) formed within each of the protrusion forming region;

wherein a tangent (12) drawn from one of the protrusions in the lateral direction passes outside of a base peripheral edge (6), and an auxiliary protrusion (3) is formed on the base at each of the positions of 90 degrees and 270 degrees from the reference line, and wherein the protruding length (1) of the auxiliary protrusion (3) from the base peripheral edge (6) is from 8 mm to 20 mm and the auxiliary protrusion (3) is shorter than the protrusion (2).

7. The golf bag according to claim 6, wherein all tangents (14) linking adjacent protrusions (2) and all tangents (13) linking the adjacent protrusion (2) and auxiliary protrusion (3) pass outside of the base peripheral edge (6).

8. A golf bag, comprising:

a base (1) having protrusion forming regions (5) at a first section (21) ranging from 30 to 60 degrees from a reference line, a second section (22) ranging from 120 to 150 degrees from the reference line, a third section (23) ranging from 210 to 240 degrees from the reference line, and a fourth section (24) ranging from 300 to 330 degrees from the reference line; and at least one protrusion (2) formed within each of the protrusion forming region;

wherein a tangent (12) drawn from one of the protrusions in the lateral direction passes outside of a base peripheral edge (6), and an auxiliary protrusion (3) is formed on the base at each of the positions of 90 degrees and 270 degrees from the reference line, wherein the protruding length (L) of the protrusion (2) from the base peripheral edge (6) is from 10 mm to 50 mm, and wherein the protruding length (1) of the auxiliary protrusion (3) from the base peripheral edge (6) is from 8 mm to 20 mm, and the auxiliary protrusion (3) is shorter than the protrusion (2).

9. The golf bag according to claim 8, wherein all tangents (14) linking adjacent protrusions (2) and all tangents (13) linking the adjacent protrusion (2) and auxiliary protrusion (3) pass outside of the base peripheral edge (6).

* * * * *